United States Patent [19]

Schott

[11] 3,990,657

[45] Nov. 9, 1976

[54] METHOD AND APPARATUS FOR REDUCING BALLISTIC MISSILE RANGE ERRORS DUE TO VISCOSITY UNCERTAINTIES (U)

[75] Inventor: Gene D. Schott, Los Altos, Calif.

[73] Assignee: The United States of America as represented by the Secretary of the Navy, Washington, D.C.

[22] Filed: Apr. 22, 1974

[21] Appl. No.: 463,942

[52] U.S. Cl. ..... 244/3.15; 244/3.21

[51] Int. Cl.[2] ..... F42B 15/02

[58] Field of Search ..... 244/3.1, 3.11, 3.14, 244/3.15, 3.2, 3.21, 3.22

[56] References Cited

UNITED STATES PATENTS

| | | | |
|---|---|---|---|
| 2,932,467 | 4/1960 | Scorgie | 244/3.15 |
| 2,979,284 | 4/1961 | Genden et al. | 244/3.14 |
| 3,184,182 | 5/1965 | May et al. | 244/3.22 |
| 3,249,324 | 5/1966 | Coffman | 244/3.20 |
| 3,497,161 | 2/1970 | Kissinger et al. | 244/3.20 |
| 3,758,052 | 9/1973 | McAlexander et al. | 244/3.14 |

*Primary Examiner*—Verlin R. Pendegrass

*Attorney, Agent, or Firm*—Richard S. Sciascia; Paul N. Critchlow

[57] ABSTRACT

Errors in the trajectories of balistic missiles result from a number of causes such as the velocity uncertainty of the missile during its powered flight. Prediction of these errors provides the missile circular error probability (CEP) usually in the form of a ballistic position error ellipse that is derived for each trajectory. This ellipse can be used to significantly improve performance by reducing the error probability. At a particular time ($T_1$) during the flight a radar altimeter determines the actual altitude of the missile and computation of the altitude error is made by subtracting the actual altitude from the nominal altitude at $T_1$ provided by the predetermined ellipse. Range error is computed from the relationship $\Delta$ h over tangent $\theta$ where $\theta$ is the angle of the ellipse semi-major axis with respect to the vertical. A missile control system then directs a maneuver based upon the range error to correct the error by returning the missile to its nominal trajectory.

5 Claims, 4 Drawing Figures

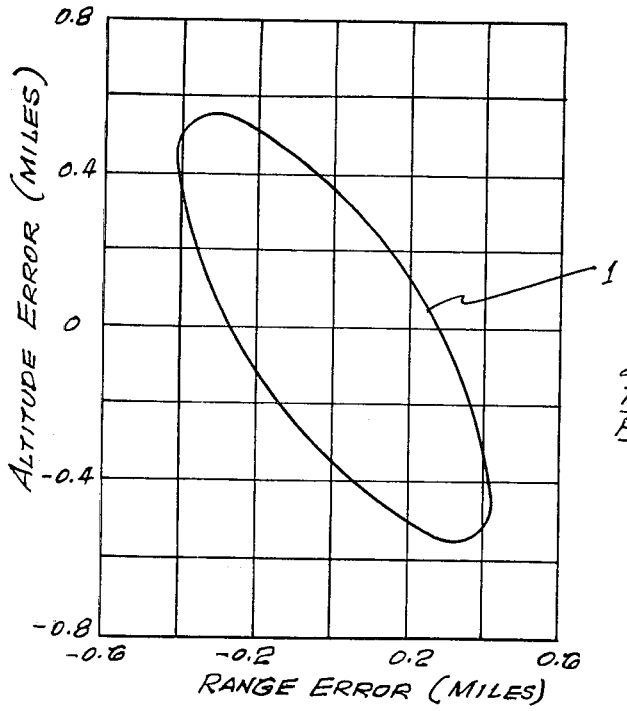
FIG. 1. TYPICAL BALLISTIC POSITION ERROR ELLIPSE.
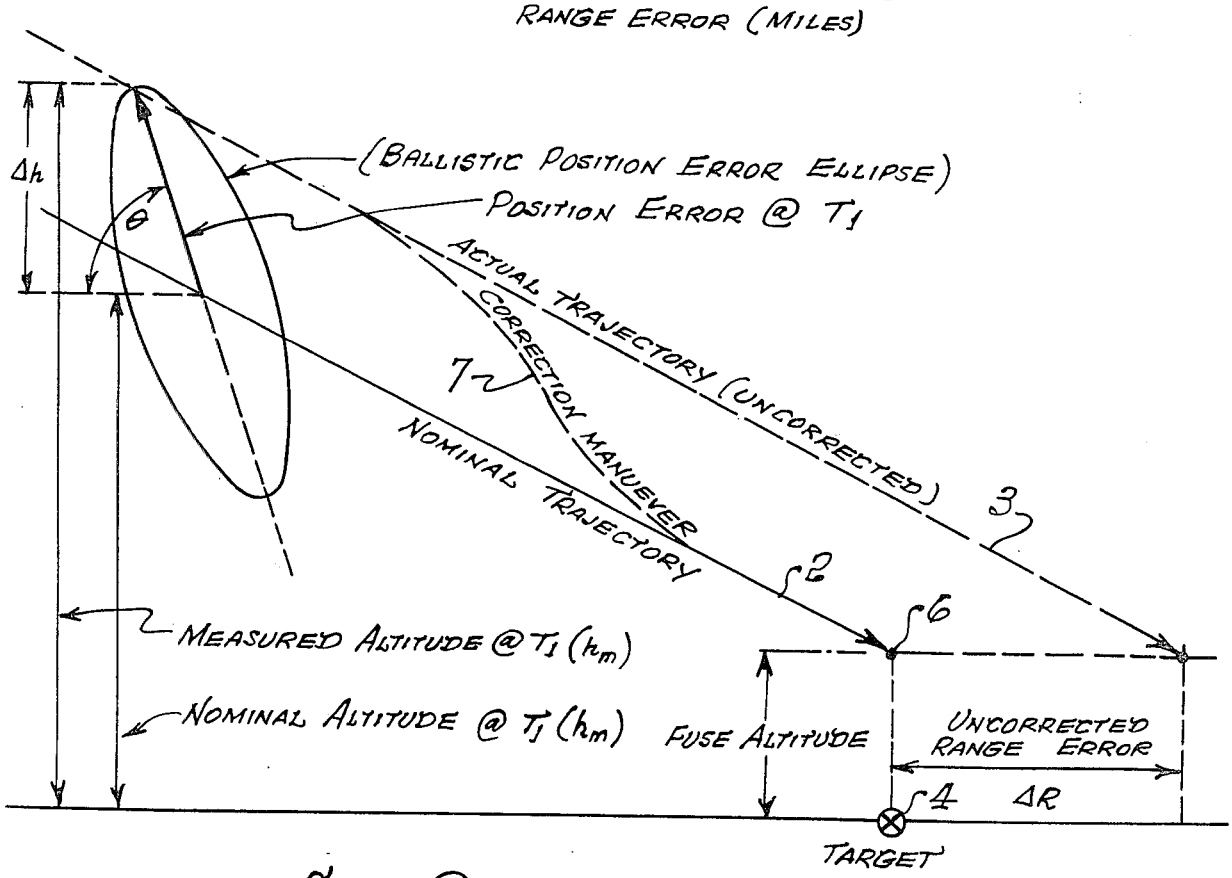
FIG. 2. TYPICAL REENTRY PROFILE

RANGE ERROR CORRECTION SYSTEM BLOCK DIAGRAM.

A COMPARISON OF RANGE & ALTITUDE ERRORS FOR VARIOUS FUSING METHODS.

METHOD AND APPARATUS FOR REDUCING BALLISTIC MISSILE RANGE ERRORS DUE TO VISCOSITY UNCERTAINTIES (U)

BACKGROUND OF THE INVENTION

The present invention relates to ballistic missiles and, in particular, to methods for reducing the missile range errors arising because of velocity uncertainties.

As is known, the theoretical flight or trajectory of ballistic missiles can be predetermined accurately. In addition, the time of the missile flight normally is very closely controlled. Consequently, the so-called 'nominal' position of the missile at any time in flight can be predicted. Such predictions, however, are not necessarily valid. For one reason, errors may occur in a trajectory due to velocity uncertainties. It is possible to plot a parameter for these position errors and such plots, known as 'ballistic position error ellipses', can be derived for each missile trajectory in a manner described by R. H. Frick, "Motion of Objects Ejected from an ICBM or a Satellite Vehicle", RM-1701, May 1, 1956, ad114192. Such ellipses have been used to predict the performance of the missile and to predetermine the probability of the effectiveness of the missile upon the intended target.

OBJECTS OF THE INVENTION

A primary object of the present invention is to provide method and apparatus for reducing ballistic missile range errors by providing information from which the trajectory error can be corrected in flight.

A more specific object is to reduce range errors by maneuvering the missile in flight to return the missile to its nominal trajectory defined by its ballistic position error ellipse.

A further object is to provide simple, effective, lightweight and inexpensive apparatus capable of being carried by the ballistic missile for range error correction purposes.

BRIEF DESCRIPTION OF THE DRAWINGS

The present invention is illustrated in the accompanying drawings of which:

FIG. 1 illustrates a so-called 'ballistic position error ellipse';

FIG. 2 shows a typical re-entry profile for a missile including both the predetermined nominal trajectory and the actual offset trajectory due to velocity error.

DETAILED DESCRIPTION OF THE INVENTION

Figure 3:
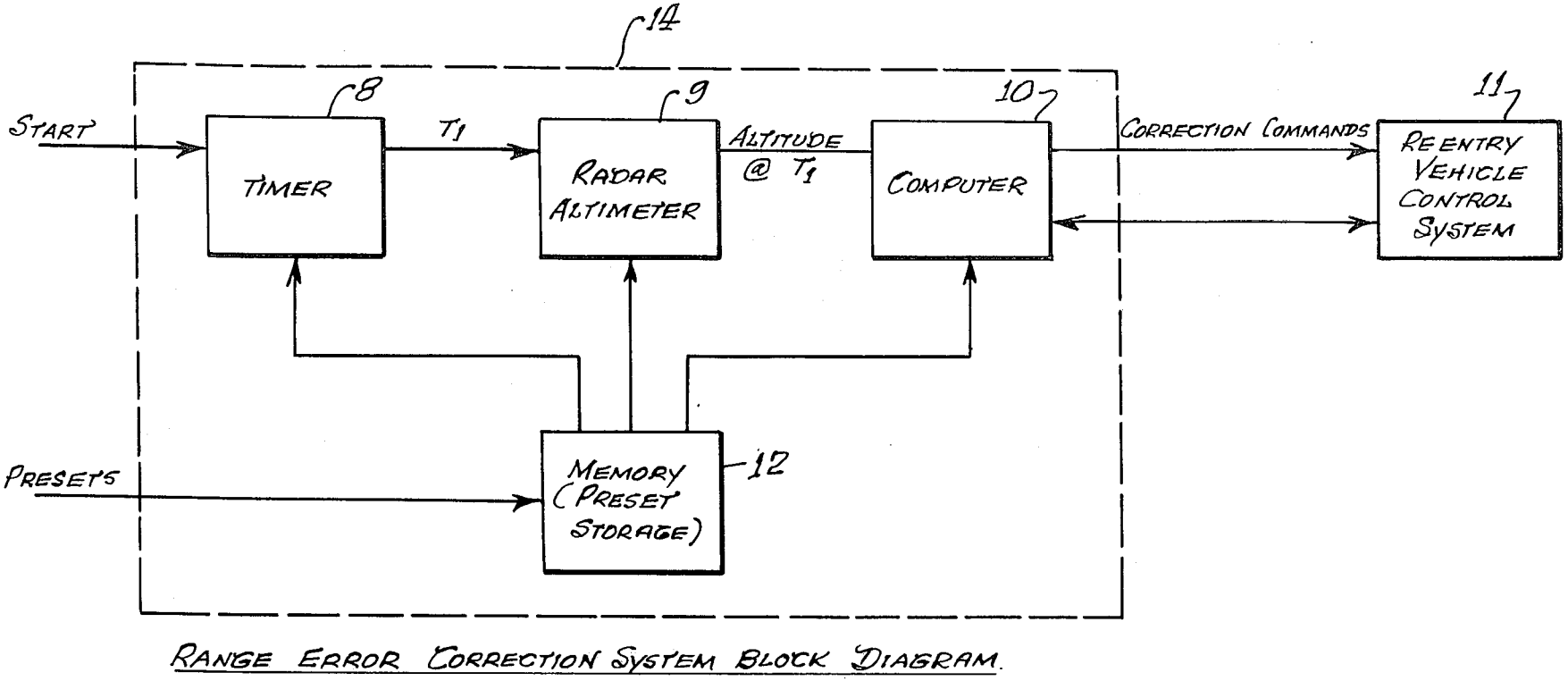
FIG. 3 is a block diagram of the present range error correction system, and FIG. 4 includes several schematics A, B and C of which A and B illustrate prior art system performances and C is a comparative illustration of the present system performance.

Referring to the drawings, FIG. 1 is a plot 1 of the position error in the trajectory plane of a missile immediately prior to re-entry into the sensible atmosphere, the error being due to velocity uncertainty measured during powered flight. Such a plot is known as a 'ballistic position error ellipse' and, as has been stated, it can be derived in the manner described in the article authored by R. H. Frick. As is known, there is a specific ellipse for each trajectory. Obviously, reduction of this error is most desirable since it would result in significant improvement in the missile circular error probability.

FIG. 2 illustrates a typical re-entry profile showing both a predetermined nominal trajectory 2 and an actual offset trajectory 3 due to a velocity error during powered flight. The nominal or theoretically-precise trajectory 2 is directed at a target 4 although, more specifically, the trajectory is directed at a particular target vertical 6 which is the altitude for which the missile fuse is set. As indicated in the drawing, if the actual trajectory of the missile is uncorrected, there will be an uncorrected range error which may degrade the effectiveness of the missile.

The range error presently is reduced by computing the altitude error of the missile at a particular time during its flight ($T_1$) and by using this altitude error to compute the range error or, in other words, the position error at $T_1$. These errors then can be used directly by the re-entry vehicle guidance and control system to perform a correction maneuver illustrated by dotted line 7 to bring the missile back into its nominal trajectory 2.

The altitude error ($\Delta h$) can be very simply computed since it involves a simple subtraction of the measured altitude from nominal attitude (see FIG. 2). More specifically, an altitude measurement ($h_m$) is made at a particular time from launch ($T_1$) and the value of this measurement is subtracted from the nominal attitude $h_m$ at $T_1$. As will be appreciated, the nominal trajectory is derived a priori and, as shown in FIG. 1, it is applicable throughout the entire timed flight of the missile. Range error, identified as $\Delta R$, also is a simple computation involving the relationship $$\frac{\Delta h}{\text{Tan } \theta}$$

where $\theta$ is the angle of the ellipse semi-major axis with respect to the target horizontal 6. In the manner to be described, these errors are used by the missile control system to permit the correction maneuver back to the nominal trajectory.

A theoretically perfect correction can be computed only in the specific case where the altitude and range errors are perfectly correlated or, in other words, where the ellipse is a straight line. In reality, if guidance velocity uncertainties are spherically distributed, the ellipse appears as shown in FIG. 1 and the computed position error is only approximate. With typical ellipses having ratios of major to minor semi-axes of 4 to 1, the uncompensated range error can be reduced approximately by a factor of 4 rather than to the 0 point shown in FIG. 2.

The performance improvements of the present system are based upon the assumptions that the velocity errors at launch vehicle cutoff are approximately spherically distributed and that position errors at launch vehicle cutoff are small compared to velocity errors.

FIG. 3 shows a block diagram of the components used in a typical system. These components include a timer 8 which is started at launch, a high-altitude radar altimeter 9 to measure altitude at $T_1$, a simple computer 10 and a re-entry vehicle guidance and control system 11 which, as will be appreciated, is the essentially-unmodified control system customarily used for the missile. In addition, a memory unit 12 is pre-set prior to launch to initiate the altitude measurement and the computations at a particular time ($T_1$) and to provide the computer with the appropriate $T_1$ ellipse information. The system is intended to be carried by the missile so as to measure the range error $\Delta R$ at a pre-set time ($T_1$) during the flight. As shown in FIG. 3, the present system includes only those components contained in the dotted-line rectangle 14 since the control system 11 is considered to be an existing component available for each missile. The computer, of course, provides control system 11 with the altitude and range errors so that the system can direct the correction maneuver. More specifically, $\Delta R$ is the horizontal component of the position error at $T_1$ as shown in FIG. 2. The uncorrected range error at fuse altitude is shown as $\Delta R_u$ and it will equal $$\Delta h \left(\frac{1}{\tan \gamma} - \frac{1}{\tan \theta}\right)$$

Considering the components in a little more detail, memory unit 12 is a storage unit pre-set with particular information. Thus, memory 12 is pre-set with the $T_1$ information to trigger timer 8 and the radar altimeter at a particular predetermined instant. Timer 8, as stated, is started at launch and it runs continuously throughout the flight trajectory. Radar altimeter 9, of course, determines the actual altitude ($h_n$) at $T_1$ and gates this altitude to computer 10. Memory 12 provides computer 10 with the value of the nominal altitude ($h_m$) at $T_1$ and the computer determines the altitude error ($\Delta h$) by the subtraction process. Also, memory 12 provides the computer with angle $\theta$ which is a particular angle for any particular nominal trajectory. In other words, the computer stores both nominal attitude at $T_1$ and the ballistic position error ellipse characteristics ($\theta$). This information is used to compute the range error.

Figure 4:
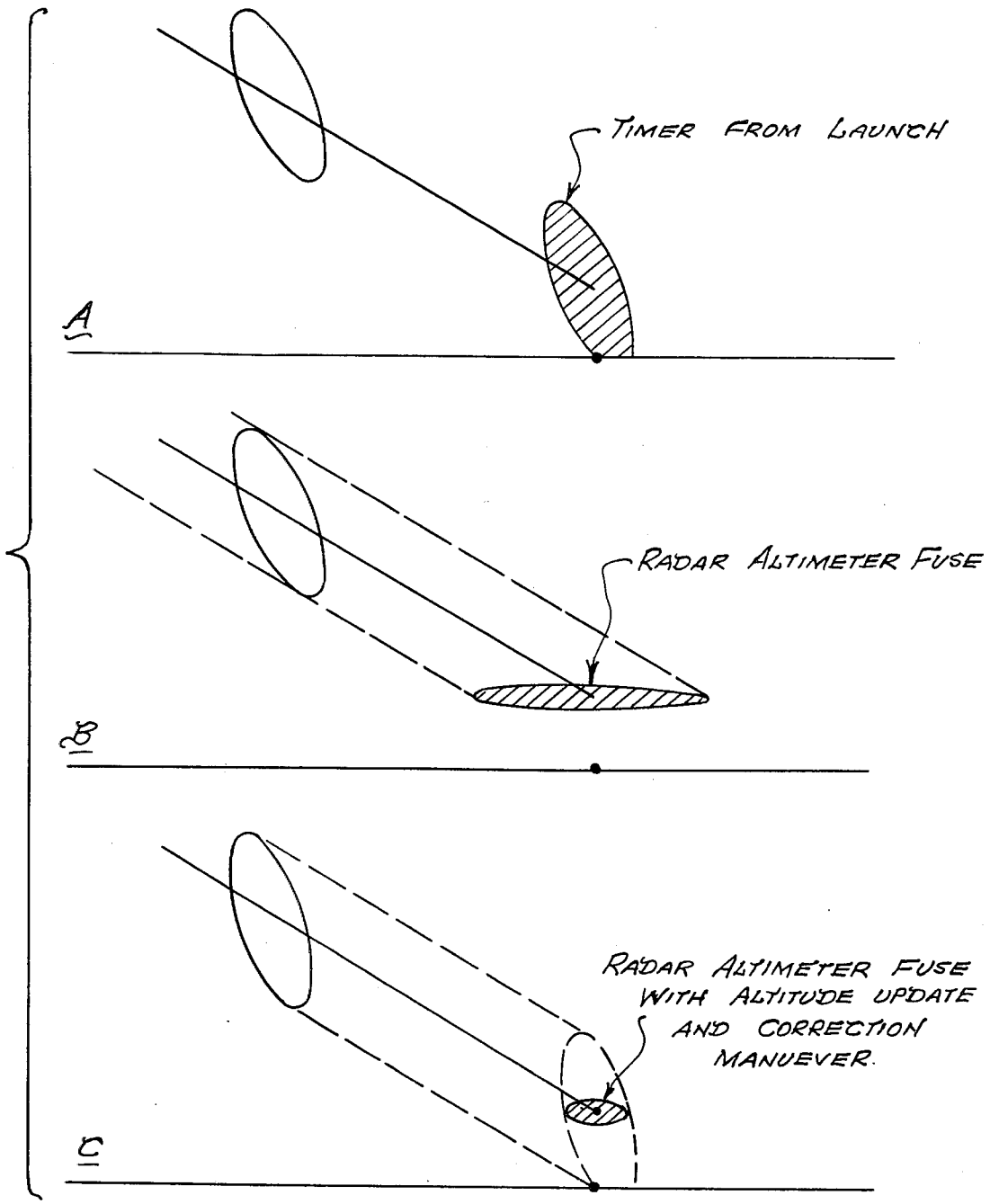

The advantages of the present system are most clearly shown in FIG. 4 which, essentially, is a comparison of range and altitude errors for various fusing methods. FIG. 4 compares three different possibilities identified as possibilities 4-A, 4-B and 4-C to show the advantages of the 4-C system which represents the present system. FIG. 4-A represents a trajectory in which the missile is detonated at a point in its trajectory controlled only by the timer which is carried by the missile and which is started at launch time. As shown by the hatched ellipse portion of FIG. 4-A, the effectiveness of the missile is reduced by the probability of error in the vertical direction. The arrangement of FIG. 4-B is one in which a radar altimeter fuse is employed. Again, the error envelope permits substantial range error in the horizontal direction due to the fact that the fuse does not initiate the detonation until a particular target vertical is reached. FIG. 4-C utilizes the same radar altimeter fuse as 4-B but, the hatched ellipse is substantially smaller than those of 4-A and 4-B since the missile has undergone the correction maneuver produced by the present system.

The advantages of the present system lie principally in the fact that a unique, simple method is provided by reducing down-range errors of ballistic missile due to velocity uncertainties. Complex terminal homing guidance sensors and computers are replaced by a simple radar altimeter and a simple error computer. Reduction of this error results in a significant improvement in missile circular error probability (CEP).

Obviously many modifications and variations of the present invention are possible in the light of the above teachings. It is therefore to be understood that within the scope of the appended claims the invention may be practiced otherwise than as specifically described.

I claim:

1. A method of improving range accuracy of ballistic missiles having a predetermined nominal trajectory defined by a specific ballistic position error ellipse comprising:

measuring the actual trajectory altitude of the missile at a particular time ($T_1$), computing the altitude error ($\Delta h$) relative to the nominal altitude at $T_1$, and computing a position error ($\Delta R$) at $T_1$ by resolving the relationship $$\frac{\Delta h}{\text{Tan } \theta},$$

where $\theta$ is the angle of said ellipse semi-major axis with respect to the target horizontal, and maneuvering the trajectory of said missile sufficiently to compensate for said computed position error.

2. The method of claim 1 wherein said computations and maneuvering are made during the re-entry-flight portion of the missile trajectory.

3. Apparatus for correcting the range accuracy of ballistic missiles having a predetermined nominal trajectory defined by a specific ballistic position error ellipse comprising, trajectory timing means, means for measuring the trajectory altitude at any time ($T_1$) during said trajectory, computing means, memory storage means, missile control means responsive to said computer means for varying the missile trajectory, said memory means being provided with preset data regarding the nominal altitude of said missile trajectory at $T_1$ and the characteristics of said position error ellipse, means for gating said data to said computer at $T_1$ whereby said computer can resolve the altitude error and the range error, and means for applying said range error data to said missile control means for correcting the range error.

4. Apparatus of claim 3 whereby said altitude error ($\Delta h$) is resolved by subtracting the nominal altitude at time $T_1$ from the measured altitude at $T_1$ and the range error is derived from the relationship $$\frac{\Delta h}{\text{Tan } \theta}$$

where $\theta$ is the angle of said ellipse major axis with respect to the target horizontal.

5. The apparatus of claim 3 wherein all of said means are carried by the missile.

* * * * *